US008128085B2

(12) United States Patent
Seki

(10) Patent No.: US 8,128,085 B2
(45) Date of Patent: Mar. 6, 2012

(54) SHEET EJECTING DEVICE

(75) Inventor: Shinobu Seki, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 140 days.

(21) Appl. No.: 12/368,404

(22) Filed: Feb. 10, 2009

(65) Prior Publication Data

US 2009/0200736 A1 Aug. 13, 2009

(30) Foreign Application Priority Data

Feb. 13, 2008 (JP) ..... 2008-031830

(51) Int. Cl.
*B65H 31/00* (2006.01)
*B65H 31/04* (2006.01)

(52) U.S. Cl. ..... 271/213; 271/209

(58) Field of Classification Search ..... 271/213, 271/207, 209, 214–219
See application file for complete search history.

(56) References Cited

U.S. PATENT DOCUMENTS

| | | | | |
|---|---|---|---|---|
| 4,605,211 | A * | 8/1986 | Sonobe | 270/58.17 |
| 5,139,254 | A * | 8/1992 | Yamashita et al. | 271/215 |
| 5,318,401 | A * | 6/1994 | Mandel | 414/792.7 |
| 5,350,169 | A * | 9/1994 | Hiroi et al. | 271/213 |
| 6,076,825 | A * | 6/2000 | Kato et al. | 271/207 |
| 6,109,606 | A * | 8/2000 | Johnson et al. | 271/213 |
| 6,145,826 | A * | 11/2000 | Kawata | 270/58.28 |
| 6,390,466 | B1 * | 5/2002 | Sanmiya | 271/213 |
| 2002/0171197 | A1 * | 11/2002 | Ardery et al. | 271/209 |

FOREIGN PATENT DOCUMENTS

JP 2005-263418 A 9/2005

* cited by examiner

*Primary Examiner* — Kaitlin Joerger
*Assistant Examiner* — Patrick Cicchino
(74) *Attorney, Agent, or Firm* — Buchanan Ingersoll & Rooney PC

(57) ABSTRACT

A sheet ejecting device having a pair of ejection rollers, a strengthener provided in a sheet ejection route, a tray for receiving ejected sheets and a driver for lifting up and down the tray. A sheet is ejected via the ejection rollers while being strengthened by the strengthener. A specified time after the sheet comes into contact with a stack of sheets on the tray, the tray is lifted up so that the contact point between the currently ejected sheet and the stack of sheets on the tray becomes nearer to the pair of ejection rollers.

10 Claims, 7 Drawing Sheets

SHEET EJECTING DEVICE

This application is based on Japanese Patent Application No. 2008-031830 filed on Feb. 13, 2008, of which content is incorporated herein by reference.

BACKGROUND OF THE INVENTION

1. Field of the Invention

The present invention relates to a sheet ejecting device, and more particularly to a sheet ejecting device that is suited to be employed in an image forming apparatus such as an electrophotographic copying machine or a printer, or in an after-processing device such as a finisher connected to the image forming apparatus.

2. Description of Related Art

When a printed sheet is ejected from an image forming apparatus onto a sheet tray through a pair of ejection rollers, if the sheet is soft, trouble will occur. Specifically, the leading part of the soft sheet bends downward, and the sheet interferes with sheets already ejected and stacked on the tray. Thereby, the sheets stacked on the tray will be out of alignment.

JP2005-263418A discloses a way of avoiding this trouble. According to this conventional way, a currently ejected sheet is curved in a direction perpendicular to the sheet ejecting direction by use of a spring or an elastic member, so that the leading edge of the currently ejected sheet will be in contact with a stack of sheets on the tray at a point farther from the pair of ejection rollers. Thereby, the leading part of the currently ejected sheet is prevented from interfering with the stack of sheets on the tray and from pushing the stack of sheets on the tray out of alignment. However, since the currently ejected sheet is curved and strengthened evenly from the leading edge to the trailing edge, the sheet may jump out of the pair of ejection rollers with great force, and consequently, the sheet may push the stack of sheets on the tray out of alignment.

FIG. 11*a* shows a case of ejecting a sheet S onto a sheet tray 110 while not strengthening the sheet S. If the sheet S is very soft, the leading part of the sheet S bends downward after coming out of the ejection rollers 101 and interferes with a stack of sheets S' at a position near the ejection rollers 101, and the stack of sheets S' is pushed.

As FIG. 11*b* shows, when the sheet S is strengthened and ejected, the leading edge of the sheet S comes into contact with the stack of sheets S' at a point farther from the ejection rollers 101, and the interference between the sheet S and the stack of sheets S' is eased. Thereby, the sheet S is ejected onto the sheet tray 110 in alignment with the stack of sheets S'. FIG. 11*c* shows a case of ejecting a sheet S1 of a relatively large size while strengthening the sheet S1 from the leading edge to the trailing edge evenly. In this case, before the trailing edge of the sheet S1 comes out of the ejection rollers 101, the strengthened sheet S1 becomes soft again, and it does not occur that the sheet S1 is tense between the ejection rollers 101 and the stack of sheets S'. Thereby, the sheet S1 is ejected onto the stack of sheets S' smoothly, and there is no possibility that the sheet S1 and the stack of sheets S' on the sheet tray 110 will be out of alignment.

FIG. 11*d* shows a case of ejecting a sheet S2 of a relatively small size while strengthening the sheet S2. In this case, the leading edge of the strengthened sheet S2 comes into contact with the stack of sheets S', and while the sheet S2 keeps strong, the trailing edge of the sheet S2 comes out of the ejection rollers 101. Therefore, the sheet S2 is tense between the ejection rollers 101 and the stack of sheets S', and the sheet S2 comes out of the ejection rollers 101 with great force. Thereby, the sheet S2 cannot be in alignment with the stack of sheets S'.

SUMMARY OF THE INVENTION

An object of the present invention is to provide a sheet ejecting device for ejecting a sheet onto a tray while strengthening the sheet, in which the sheet is prevented from pushing a stack of sheets on the tray out of alignment, and in which the sheet is ejected in alignment with the stack of sheets on the tray.

In an aspect of the present invention, a sheet ejecting device for ejecting printed sheets one by one comprises: a pair of ejection rollers for ejecting a sheet; a strengthener, provided in a sheet ejection route, for strengthening a sheet; a tray for receiving sheets ejected via the pair of ejection rollers and holding the sheets in a stack; and a mechanism for changing a distance between a contact point of a currently ejected sheet with the stack of sheets held on the tray and the pair of ejection rollers.

In the sheet ejecting device, since a sheet is strengthened and ejected, the currently ejected sheet is prevented from bending downward, and thereby, is prevented from pushing a stack of sheets on the tray out of alignment. Moreover, since the contact point of the currently ejected sheet with the stack of sheets on the tray is moved closer to the pair of ejection rollers, the force provided for the sheet by the strengthener is cancelled. Accordingly, even if the sheet has a relatively small dimension in the sheet ejecting direction, there is no possibility that the sheet may jump out of the pair of ejection rollers with great force, and the sheet is prevented from pushing the stack of sheets on the tray out of alignment.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Sheet ejecting devices according to embodiments of the present invention are hereinafter described with reference to the drawings. In the following embodiments, the same members and parts are provided with the same reference symbols, and repetitious descriptions are omitted.

First Embodiment

Figure 1:
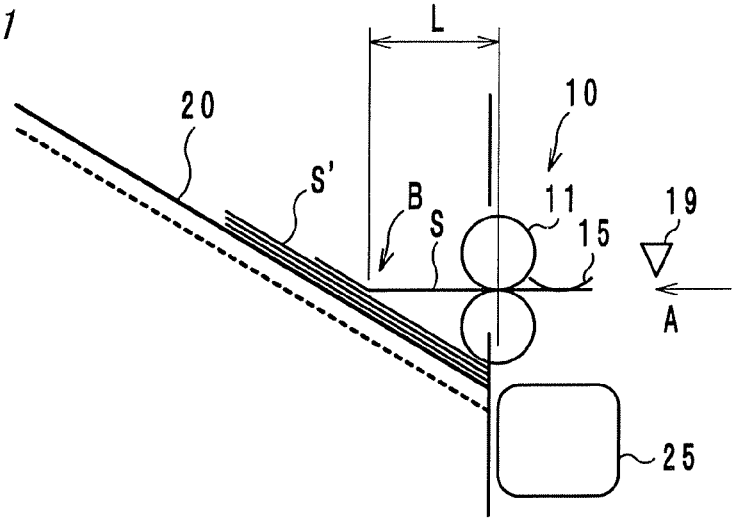
FIG. 1 is a schematic elevation view of a sheet ejecting device according to a first embodiment of the present invention.

See FIG. 1

As FIG. 1 shows, a sheet ejecting device according to a first embodiment is used as a sheet ejecting section 10 of an image forming apparatus, such as a copying machine and a printer, or of an after-processing device, such as a finisher, connected to the image forming apparatus. The sheet ejecting device generally comprises a pair of ejection rollers 11 for ejecting a sheet S, a strengthener 15, located in a sheet ejection route, for strengthening a sheet S, a sheet sensor 19 located in the sheet ejection route, a tray 20 for receiving sheets S ejected via the pair of ejection rollers 11 and holding the sheets S in a stack, and a driver section 25 (composed of a motor and a gear or a rack and a pinion, etc.) for lifting up and down the tray 20.

A printed sheet S is fed from a direction indicated by an arrow "A" into a nip portion of the ejection rollers 11 and is ejected onto the tray 20 by the rotation of the ejection rollers 11. In this moment, the strengthener 15 curves the sheet S in a direction perpendicular to the ejecting direction "A" such that the curvature extends in the ejecting direction "A", and the curved and strengthened sheet S is ejected onto the tray 20.

The strengthened sheet S comes into contact with a stack of sheets S' on the tray 20 at a point farther from the ejection rollers 11 than a point at which a non-strengthened sheet comes into contact with the stack of sheets S' on the tray 20. Therefore, there is no possibility that the sheet S will push the stack of sheets S' out of alignment.

A specified time after the leading edge of the sheet S is detected by the sensor 19, and specifically, between the time when the leading edge of the sheet S comes into contact with the stack of sheets S' and the time when the sheet S passes through the nip portion of the ejection rollers 11, the tray 20 is lifted up by a specified distance (from the position shown by the dashed line to the position shown by the solid line). Accordingly, the point B at which the sheet S currently ejected via the ejection rollers 11 comes into contact with the stack of sheets S' comes nearer to the ejection rollers 11, that is, the distance L between the contact point B and the nip portion of the pair of ejection rollers 11 becomes shorter. Thereby, the force provided for the sheet S by the strengthener 15 is cancelled. Thus, when the sheet S passes through the ejection rollers 11, the sheet S is no longer strengthened, and there is no possibility that the sheet S may jump out of the ejection rollers 11 with great force. Consequently, the sheets S' can be kept in alignment on the tray 20. After the sheet S is ejected onto the tray 20, the tray 20 is lifted down to the initial level.

Second Embodiment

Figure 2:
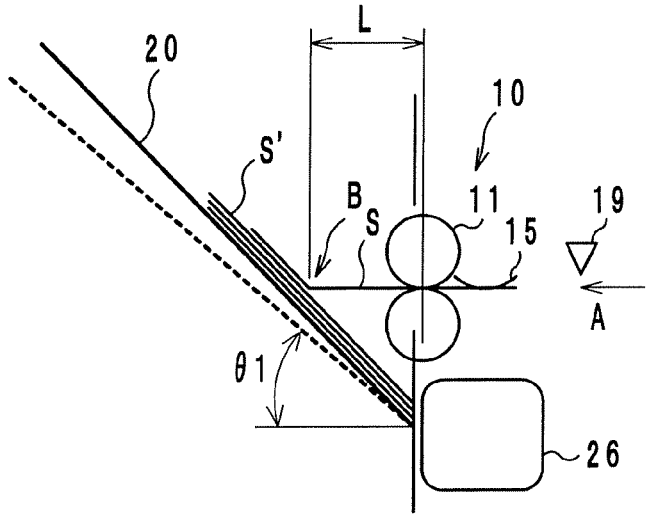
FIG. 2 is a schematic elevation view of a sheet ejecting device according to a second embodiment of the present invention.

See FIG. 2

A second embodiment of the present invention, which is shown by FIG. 2, basically has the same structure as the first embodiment. A sheet ejecting device according to the second embodiment has a driver section 26 (composed of a motor, a gear, etc.) for changing an angle θ1 of the tray 20 to the sheet ejection route.

Like in the first embodiment, a printed sheet S is strengthened by the strengthener 15 and is ejected onto the tray 20. The strengthened sheet S comes into contact with a stack of sheets S' on the tray 20 at a point farther from the ejection rollers 11 than a point at which a non-strengthened sheet comes into contact with the stack of sheets S' on the tray 20. Therefore, there is no possibility that the sheet S will push the stack of sheets S' out of alignment.

A specified time after the leading edge of the sheet S is detected by the sensor 19, and specifically, between the time when the leading edge of the sheet S comes into contact with the stack of sheets S' and the time when the sheet S passes through the nip portion of the pair of ejection rollers 11, the tray 20 is pushed to stand such that the angle θ1 becomes larger (from the position shown by the dashed line to the position shown by the solid line). Accordingly, the point B at which the sheet S currently ejected via the ejection rollers 11 comes into contact with the stack of sheets S' comes nearer to the ejection rollers 11, that is, the distance L between the contact point B and the nip portion of the ejection rollers 11 becomes shorter. Thereby, the force provided for the sheet S by the strengthener 15 is cancelled. Thus, when the sheet S passes through the ejection rollers 11, the sheet S is no longer strengthened, and there is no possibility that the sheet S may jump out of the ejection rollers 11 with great force. Consequently, the sheets S' can be kept in alignment on the tray 20. After the sheet S is ejected onto the tray 20, the tray 20 is returned such that the angle θ1 becomes to the initial value.

Third Embodiment

Figure 3:
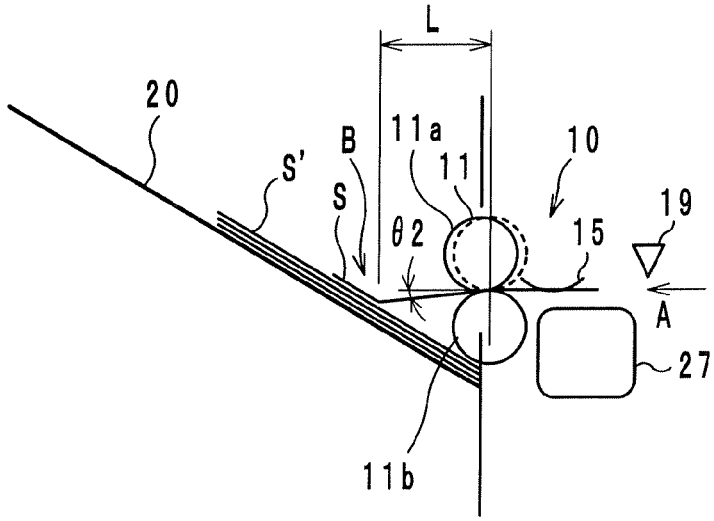
FIG. 3 is a schematic elevation view of a sheet ejecting device according to a third embodiment of the present invention.

See FIG. 3

A third embodiment of the present invention, which is shown by FIG. 3, basically has the same structure as the first embodiment. A sheet ejecting device according to the third embodiment has a driver section 27 (composed of a motor, a gear, etc.) for changing a sheet ejection angle θ2 that is an angle of a sheet S ejected via the ejection rollers 11 to the horizontal direction.

Like in the first embodiment, a printed sheet S is strengthened by the strengthener 15 and is ejected onto the tray 20. The strengthened sheet S comes into contact with a stack of sheets S' on the tray 20 at a point farther from the pair of rollers 11 than a point at which a non-strengthened sheet comes into contact with the stack of sheets S' on the tray 20. Therefore, there is no possibility that the sheet S will push the stack of sheets S' out of alignment.

A specified time after the leading edge of the sheet S is detected by the sensor 19, and specifically, between the time when the leading edge of the sheet S comes into contact with the stack of sheets S' and the time when the sheet S passes through the nip portion of the ejection rollers 11, the sheet ejection angle θ2 is increased. Specifically, an upper roller 11*a* of the ejection rollers 11 is somewhat pivoted on a lower roller 11*b* from the position shown by the dashed line to the position shown by the solid line. Thereby, the point B at which the sheet S currently ejected via the ejection rollers 11 comes into contact with the stack of sheets S' comes nearer to the ejection rollers 11, that is, the distance L between the contact point B and the nip portion of the ejection rollers 11 becomes shorter. Thereby, the force provided for the sheet S by the strengthener 15 is cancelled. Thus, when the sheet S passes through the ejection rollers 11, the sheet S is no longer strengthened, and there is no possibility that the sheet S may jump out of the ejection rollers 11 with great force. Consequently, the sheets S' can be kept in alignment on the tray 20.

After the sheet S is ejected onto the tray 20, the upper roller 11*a* is returned such that the sheet ejection angle θ2 becomes to the initial value.

Strengthener

Figure 4:
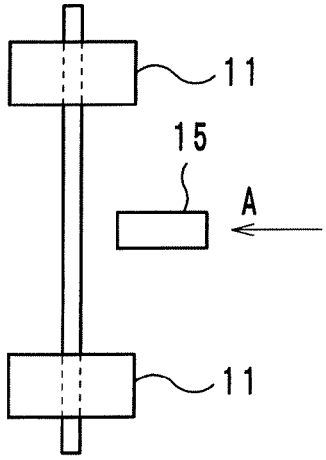
FIG. 4 is a plan view showing an arrangement of a strengthener.
Figure 5:
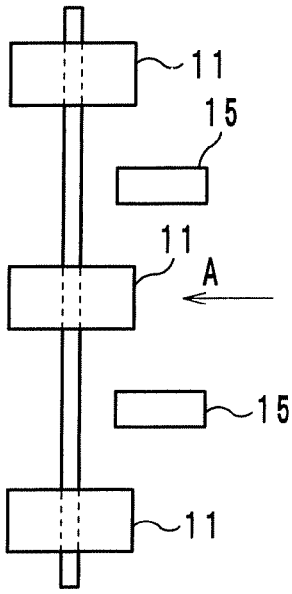
FIG. 5 is a plan view showing another arrangement of the strengthener.

See FIGS. 4-6

Now, the strengthener 15 is described. The strengthener 15 is made of metal, resin or an elastic material and is located in a position somewhat advancing into the sheet ejection route. As shown by FIG. 4, the strengthener 15 is located between wheels of the ejection rollers 11. As the strengthener 15, only one component may be provided in the center with respect to the direction perpendicular to the sheet ejecting direction "A". Alternatively, two or more components may be provided among wheels of the ejection rollers 11 as shown by FIG. 5.

Figure 6A:
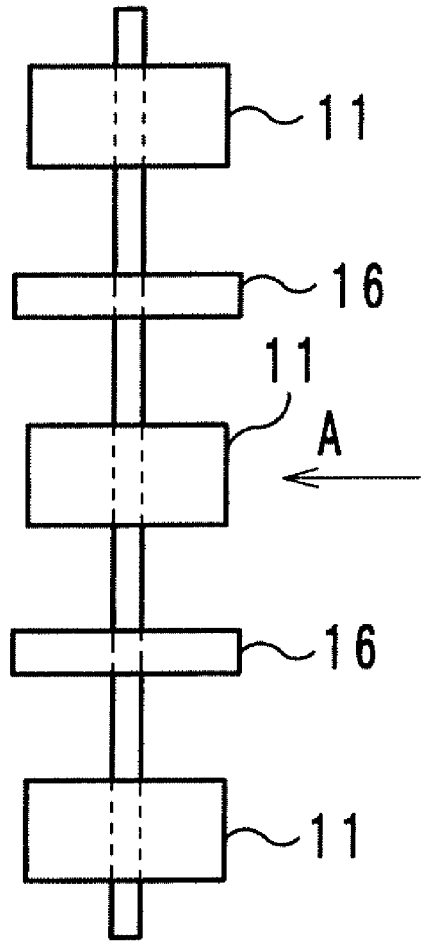
FIGS. 6*a* and 6*b* show an arrangement of strengthening wheels, FIG. 6*a* being a plan view and FIG. 6*b* being a front view.
Figure 6B:
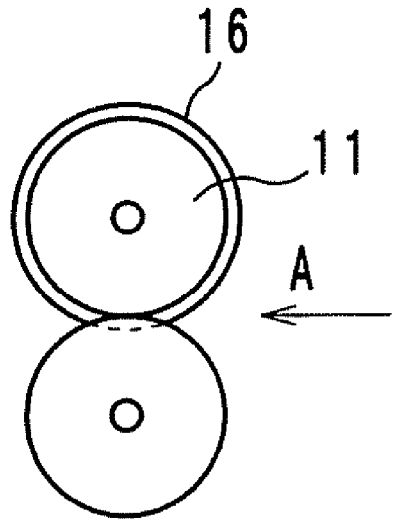

As shown by FIGS. 6*a* and 6*b*, it is possible to provide a strengthening wheel 16 coaxially with the upper roller 11*a* of the ejection rollers 11. The strengthening wheel 16 has a diameter slightly larger than the wheels of the upper roller 11*a*. Only one strengthening wheel 16 may be provided in the center in the direction perpendicular to the sheet ejecting direction "A", or alternatively, two or more strengthening wheels 16 may be provided among the wheels of the upper roller 11*a* as shown by FIG. 6*a*. The strengthening wheel(s) 16 may be provided coaxially with the lower roller 11*b* of the ejection rollers 11. Further, the strengthening wheels 16 may be provided coaxially with both the upper roller 11*a* and the lower roller 11*b*.

First Control Procedure

Figure 7:
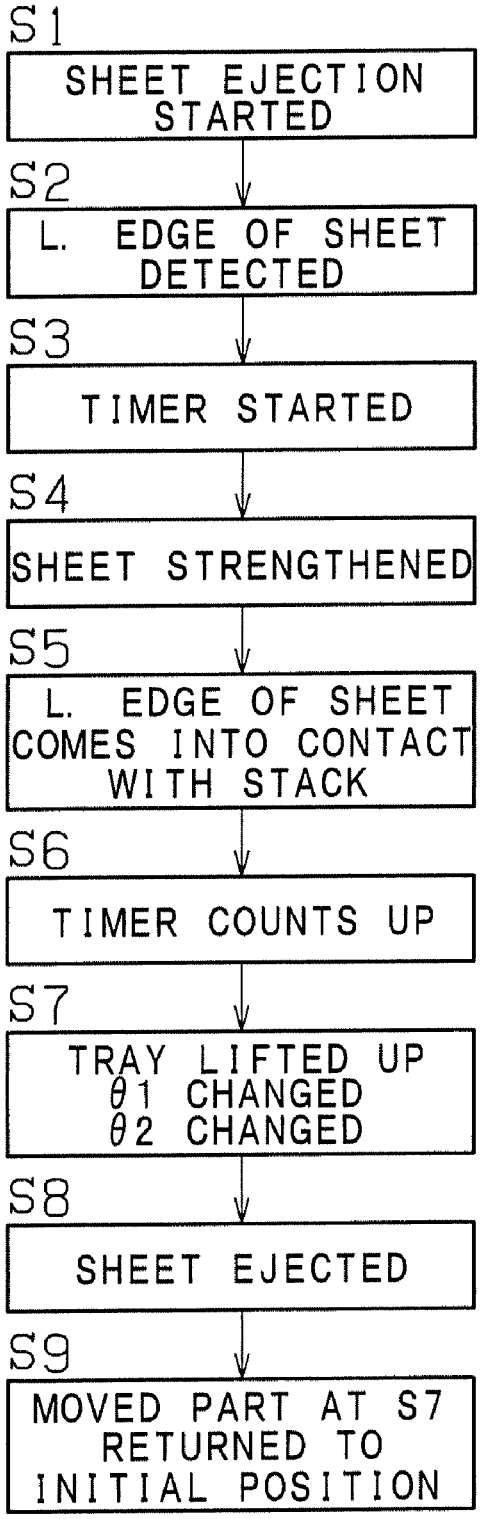
FIG. 7 is a flowchart showing a first control procedure.

See FIG. 7

Referring to FIG. 7, a control procedure carried out in each of the sheet ejecting devices according to the first embodiment, the second embodiment and the third embodiment is described. Ejection of a sheet S is started (step S1), and when the leading edge of the sheet S is detected by the sensor 19 (step S2), a timer is started (step S3). Thereafter, the sheet S is strengthened by the strengthener 15 (step S4). The leading edge of the sheet S comes into contact with a stack of sheets S' on the tray 20 (step S5), and when the timer counts up a specified time (step S6), a lift-up of the tray 20 (in the first embodiment), a change of the angle θ1 (in the second embodiment) or a change of the angle θ2 (in the third embodiment) is performed (step S7). Thereafter, when ejection of the sheet S onto the tray 20 is completed (step S8), the portion moved at step S7 is returned to the initial position (step S9). Thus, ejection of one sheet S is completed.

Setting of Distance L

Figure 8:
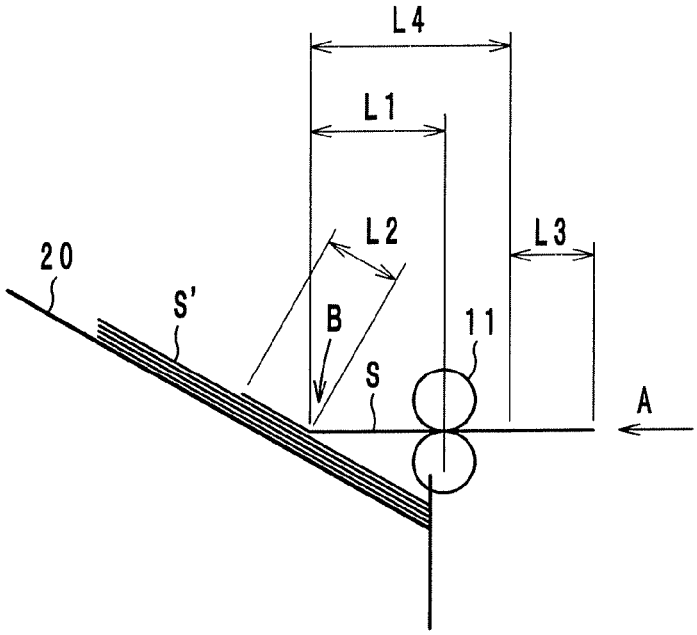
FIG. 8 is an illustration of distances L1 and L4 in the case of A4-vertical sheet ejection.
Figure 9:
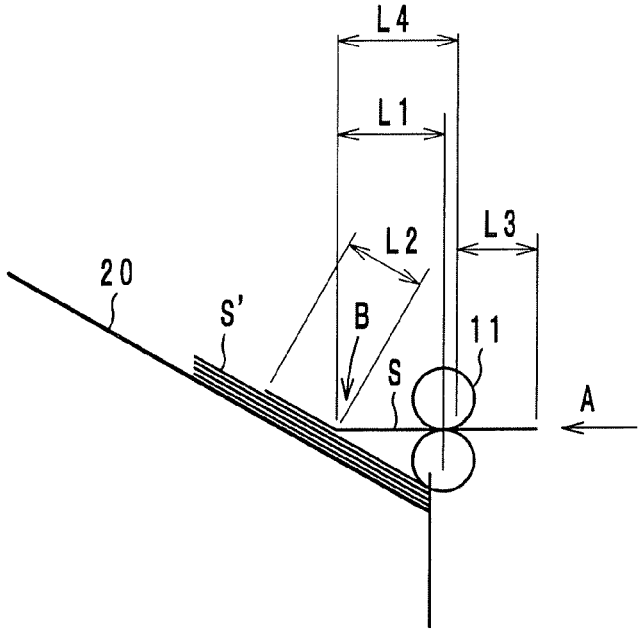
FIG. 9 is an illustration of distances L1 and L4 in the case of A4-lateral sheet ejection.

See FIGS. 8-9

In each of the first, the second and the third embodiments, the distance L between the nip portion of the ejection rollers 11 and the contact point B of the sheet S with the stack of sheets S' after shortened by the operation of the driving section 25, 26 or 27 may be determined based on the size of the sheet S (the length of the sheet S in the ejecting direction), the kind of the sheet S, the environmental conditions, etc.

FIG. 8 shows a case wherein an A4-sized sheet is ejected with its longer sides parallel to the ejecting direction (hereinafter referred to as A4-vertical sheet ejection). FIG. 9 shows a case wherein an A4-sized sheet is ejected with its shorter sides parallel to the ejecting direction (hereinafter referred to as A4-lateral sheet ejection).

In FIGS. 8 and 9, the reference symbol "L1" denotes a distance between the nip portion of the ejection rollers 11 and the contact point B of the sheet S with the stack of sheets S'. The reference symbol "L2" denotes a predetermined distance (approximately 50 mm) by which the sheet S is further conveyed after the leading edge of the sheet S comes into contact with the stack of sheets S'. The reference symbol "L3" is a predetermined distance (approximately 50 mm) from the trailing edge of the sheet S toward the ejection roller pair 11. The distances L1 shown in FIGS. 8 and 9 are the minimum values of the distance L in the respective cases. In each case, the distance L can be lengthened to a distance L4. The distance L4 is a distance between a point of the sheet S that is located on the contact point B when the sheet S is further conveyed by the distance L2 (approximately 50 mm) after the leading edge of the sheet S comes into contact with the stack of sheets S' and a point of the sheet S at the distance L3 (approximately 50 mm) from the trailing edge thereof.

In other words, the maximum distance L4 is calculated by subtracting the distance L2 and the distance L3 from the length of the sheet S in the ejecting direction. In the case of A4-vertical sheet ejection, the length of the sheet S in the ejecting direction "A" is 297 mm. Accordingly, the distance L4 is calculated by 297−50−50, and the result is 197 mm. Therefore, the distance L should be designed to be equal to or smaller than 197 mm. In the case of A4-lateral sheet ejection, the length of the sheet S in the ejecting direction "A" is 210 mm. Accordingly, the distance L4 is calculated by 210−50−50, and the result is 110 mm. Therefore, the distance L should be designed to be equal to or smaller than 110 mm.

When the sheet S is ejected, the sheet S bends down by its own weight. The degree of the bend-down (the strength) of the sheet S depends on the kind of the sheet S (the weight per square meter, that is, whether to be thin paper, ordinary paper or thick paper and whether to be recycled paper) and the environmental conditions (temperature and humidity). Therefore, it is preferred that the distance L is changed in accordance with the kind of the sheet S and the environmental conditions.

Table 1 shows an exemplary setting of the distance L in accordance with the kind of sheet. Here, thin paper is paper with a weight per square meter smaller than 60 g/m$^2$. Ordinary paper is paper with a weight per square meter within a range from 60 g/m$^2$ to 90 g/m$^2$. Thick paper is paper with a weight per square meter greater than 90 g/m$^2$.

TABLE 1

Setting of Distance L

| | A4-Vertical | A4-Lateral |
|---|---|---|
| Thin Paper | 190 mm | 100 mm |
| Ordinary Paper | 170 mm | 80 mm |
| Thick Paper | 150 mm | 60 mm |

Further, recycled paper is not so strong as non-recycled paper, and the distance L in the case of ejecting recycled paper may be set longer than the distance L in the case of ejecting non-recycled paper with the same weight per square meter. Table 2 shows an exemplary setting.

TABLE 2

| Setting of Distance L | | |
|---|---|---|
| | A4-Vertical | A4-Lateral |
| Recycled Paper | 180 mm | 90 mm |
| Non-Recycled Paper | 170 mm | 80 mm |

Moreover, when the temperature and/or the humidity is high, it is preferred that the distance L is set to be longer. Table 3 shows an exemplary setting of the distance L in accordance with whether the sheet ejecting device is under high temperature and high humidity, under ordinary temperature and ordinary humidity, or under low temperature and low humidity.

TABLE 3

| Setting of Distance L | | |
|---|---|---|
| | A4-Vertical | A4-Lateral |
| High-Temp/High-Humid | 190 mm | 100 mm |
| Ordinary-Temp/Ordinary-Humid | 170 mm | 80 mm |
| Low-Temp/Low-Humid | 150 mm | 60 mm |

Second Control Procedure

Figure 10:
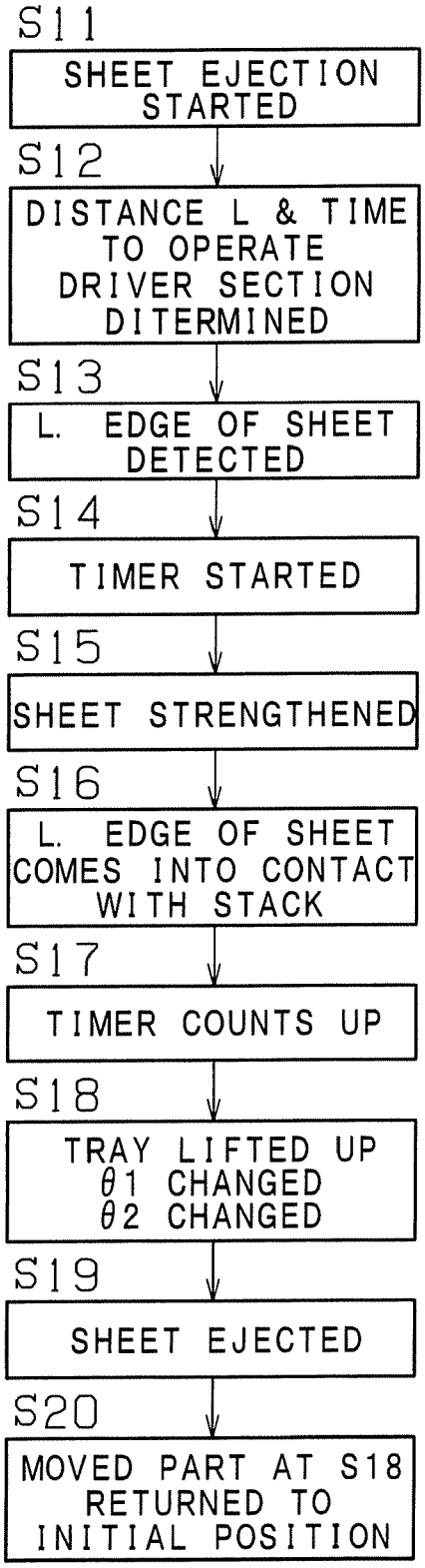
FIG. 10 is a flowchart showing a second control procedure.
Figure 11A:
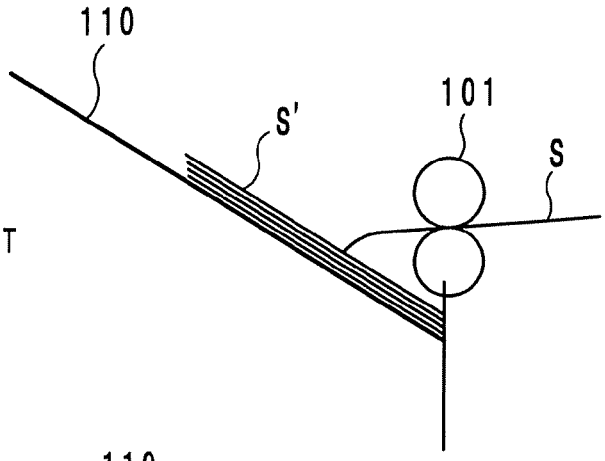
FIG. 11a PRIOR ART
FIGS. 11*a*-11*d* are illustrations of sheet ejection performed by a conventional sheet ejecting device.
Figure 11B:
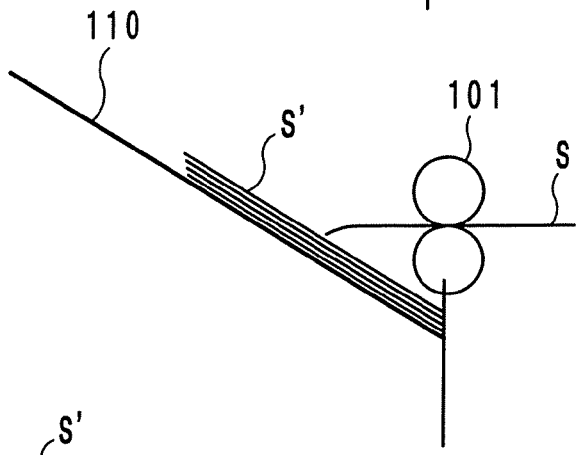
FIG. 11b PRIOR ART
Figure 11C:
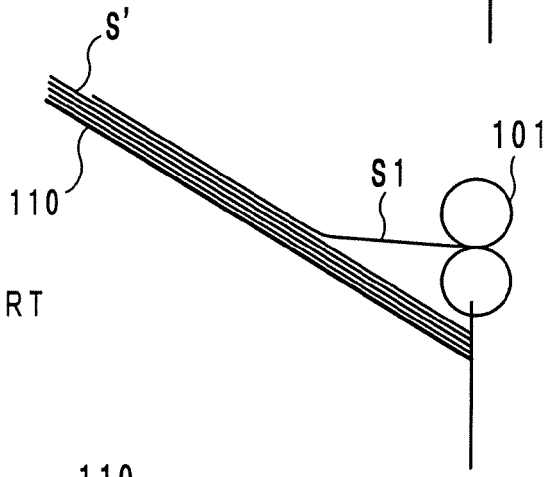
FIG. 11c PRIOR ART
Figure 11D:
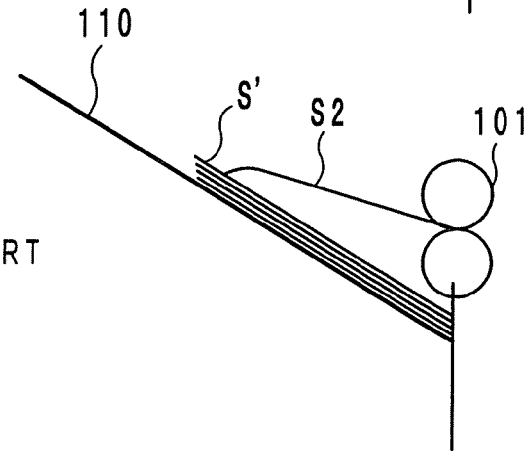
FIG. 11d PRIOR ART

See FIG. 10

Referring to FIG. 10, a procedure for changing the distance L that is determined based on the conditions in each of the first, the second and the third embodiments is described. When ejection of a sheet S is started (step S11), the distance L and the time to operate the driving section 25, 26 or 27 are determined based on the size and the kind of the sheet S and the environmental conditions (step S12). When the leading edge of the sheet S is detected by the sensor 19 (step S13), a timer is started (step S14). Then, the sheet S is strengthened by the strengthener 15 (step S15), and the leading edge of the sheet S comes into contact with the stack of sheets S' (step S16). When the timer counts up a specified time (step S17), a lift-up of the tray 20 (in the first embodiment), a change of the angle θ1 (in the second embodiment) or a change of the angle θ2 (in the third embodiment) is performed (step S18). Thereafter, when ejection of the sheet S onto the tray 20 is completed (step S19), the portion moved at step S18 is returned to the initial position (step S20). Thus, ejection of one sheet S is completed.

Other Embodiments

It is possible to combine the first embodiment, the second embodiment and the third embodiment with one another. For example, a lift-up of the tray 20 and a change of the ejection angle θ2 may be combined with each other, or alternatively, a change of the angle θ1 of the tray 20 and a change of the ejection angle θ2 may be combined with each other. Further, the detailed constructions of the tray 20, the ejection rollers 11 and the strengthener 15 may be arbitrarily designed.

Although the present invention has been described in connection with the preferred embodiments above, various changes and modifications are possible to those who are skilled in the art. Such changes and modifications are to be understood as being within the scope of the present invention.

What is claimed is:

1. A sheet ejecting device for ejecting printed sheets one by one, said device comprising:

a pair of ejection rollers for engaging a sheet to thereby eject the sheet;

a strengthener, provided in a sheet ejection route, for strengthening a currently engaged sheet by providing a force for the currently engaged sheet;

a tray for receiving sheets ejected via the pair of ejection rollers and holding the sheets in a stack; and a mechanism for changing a distance between a contact point of the currently engaged sheet, which is a sheet currently engaged by the pair of ejection rollers, with the stack of sheets held on the tray and the pair of ejection rollers to thereby reduce the force provided for the currently engaged sheet by the strengthener.

2. A sheet ejecting device according to claim 1, wherein the mechanism is a driver for lifting up and down the tray; and wherein the driver lifts up the tray so that the contact point of the currently engaged sheet with the stack of sheets held on the tray becomes nearer to the pair of ejection rollers.

3. A sheet ejecting device according to claim 1, wherein the mechanism is a driver for changing an angle of the tray to the sheet ejection route; and wherein the driver increases the angle of the tray to the sheet ejection route so that the contact point of the currently engaged sheet with the stack of sheets held on the tray becomes nearer to the pair of ejection rollers.

4. A sheet ejecting device according to claim 1, wherein the mechanism is a driver for changing a sheet ejection angle of the pair of ejection rollers; and wherein the driver changes the sheet ejection angle of the pair of ejection rollers so that the contact point of the currently engaged sheet with the stack of sheets held on the tray becomes nearer to the pair of ejection rollers.

5. A sheet ejecting device for ejecting printed sheets one by one, said device comprising:

a pair of ejection rollers for engaging a sheet to thereby eject the sheet;

a strengthener, provided in a sheet ejection route, for strengthening a currently engaged sheet by providing a force for the currently engaged sheet;

a tray for receiving sheets ejected via the pair of ejection rollers and holding the sheets in a stack; and at least one of a driver for lifting up and down the tray, a driver for changing an angle of the tray to the sheet ejection route and a driver for changing a sheet ejection angle, wherein the at least one of the drivers lifts up the tray, increases the angle of the tray to the sheet ejection route or changes the sheet ejection angle so that a contact point of the currently engaged sheet, which is a sheet currently engaged by the pair of ejection rollers, with the stack of sheets held on the tray becomes nearer to the pair of ejection rollers to thereby reduce the force provided for the currently engaged sheet by the strengthener.

6. A sheet ejecting device according to claim 1, wherein the mechanism changes the distance between the contact point of the currently engaged sheet with the stack of sheets held on the tray and the pair of ejection rollers by an amount determined based on a size of the currently engaged sheet.

7. A sheet ejecting device according to claim 1, wherein the mechanism changes the distance between the contact point of the currently engaged sheet with the stack of sheets held on the tray and the pair of ejection rollers by an amount determined based on a kind of the currently engaged sheet.

8. A sheet ejecting device according to claim 7, wherein the kind of the currently engaged sheet, which determines the amount of the change in the distance, is whether the sheet is thin paper, ordinary paper, thick paper or whether the sheet is recycled paper.

9. A sheet ejecting device according to claim 1, wherein the mechanism changes the distance between the contact point of the currently engaged sheet with the stack of sheets held on the tray and the pair of ejection rollers by an amount determined based on an environmental condition.

10. A sheet ejecting device according to claim 9, wherein the environmental condition, which determines the amount of the change in the distance is whether the device is under high temperature and high humidity, under ordinary temperature and ordinary humidity, or under low temperature and low humidity.

* * * * *